US008024180B2

(12) United States Patent
Lee et al.

(10) Patent No.: US 8,024,180 B2
(45) Date of Patent: Sep. 20, 2011

(54) METHOD AND APPARATUS FOR ENCODING ENVELOPES OF HARMONIC SIGNALS AND METHOD AND APPARATUS FOR DECODING ENVELOPES OF HARMONIC SIGNALS

(75) Inventors: Nam-suk Lee, Suwon-si (KR); Geon-hyoung Lee, Hwaseong-si (KR); Jae-one Oh, Yongin-si (KR); Chul-woo Lee, Suwon-si (KR); Jong-hoon Jeong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 901 days.

(21) Appl. No.: 12/022,581

(22) Filed: Jan. 30, 2008

(65) Prior Publication Data

US 2008/0235034 A1 Sep. 25, 2008

(30) Foreign Application Priority Data

Mar. 23, 2007 (KR) ..... 10-2007-0028870

(51) Int. Cl.
*G10L 19/02* (2006.01)
*G10L 11/04* (2006.01)

(52) U.S. Cl. ..... 704/203; 704/207

(58) Field of Classification Search ..... None
See application file for complete search history.

(56) References Cited

U.S. PATENT DOCUMENTS 5,574,823 A * 11/1996 Hassanein et al. ..... 704/208
5,630,011 A * 5/1997 Lim et al. ..... 704/205
5,787,387 A 7/1998 Aguilar
6,269,332 B1 7/2001 Choo et al.
6,278,971 B1 * 8/2001 Inoue et al. ..... 704/205
6,292,777 B1 * 9/2001 Inoue et al. ..... 704/230
6,377,914 B1 * 4/2002 Yeldener ..... 704/205
7,127,389 B2 10/2006 Chazan et al.
7,373,296 B2 * 5/2008 Van De Par et al. ..... 704/226
7,523,032 B2 * 4/2009 Heikkinen et al. ..... 704/207
2005/0228648 A1 * 10/2005 Heikkinen ..... 704/205

FOREIGN PATENT DOCUMENTS

KR 10-2002-0022256 A 3/2002
KR 10-2006-0070693 A 6/2006

OTHER PUBLICATIONS

Louis B. Almeida and Jose M. Tribolet "Harmonic Coding: A Low Bit-Rate, Good-Quality Speech Coding Technique", Proc. IEEE ICASSP '82, p. 1664-1667, 1982.*

* cited by examiner

*Primary Examiner* — Talivaldis Ivars Smits
(74) *Attorney, Agent, or Firm* — Sughrue Mion, PLLC

(57) ABSTRACT

Provided are a methods and apparatuses for encoding/decoding an audio signal to efficiently encode/decode a harmonic envelope. The method of encoding an audio signal includes performing harmonic analysis with respect to an input signal to determine harmonic parameters with respect to harmonic signals; correlating the amplitudes of the harmonic signals to signals in a time domain instead of signals in a frequency domain; applying a time-frequency transformation operation to the amplitudes in the time domain to generate time-frequency transformed values in the frequency domain; and encoding the time-frequency transformed values. When expressing a harmonic envelope, the amplitudes of the harmonic signals are regarded as signals in the time domain so as to perform a time-frequency transformation and only a part from among the transformed values is selected to be encoded. Therefore, sound quality is not affected and coding efficiency greatly improves.

20 Claims, 5 Drawing Sheets

METHOD AND APPARATUS FOR ENCODING ENVELOPES OF HARMONIC SIGNALS AND METHOD AND APPARATUS FOR DECODING ENVELOPES OF HARMONIC SIGNALS

CROSS-REFERENCE TO RELATED PATENT APPLICATION

This application claims priority from Korean Patent Application No. 10-2007-0028870, filed on Mar. 23, 2007, in the Korean Intellectual Property Office, the disclosure of which is incorporated herein in its entirety by reference.

BACKGROUND OF THE INVENTION

1. Field of the Invention

Apparatuses and methods consistent with the present invention relate to encoding of an audio signal, and more particularly, to encoding an envelope of a harmonic signal and decoding encoded data.

2. Description of the Related Art

Parametric coding is an example of a method of encoding an audio signal. Assuming that the audio signal to be encoded is formed of only sinusoidal signals and noise signals, the parametric coding method firstly extracts sinusoidal signals from the audio signal to be encoded and encodes remaining signals. In a Harmonic and Individual Lines and Noise (HILN) method which is one of the parametric coding methods, harmonic signals from among the sinusoidal signals are firstly encoded (harmonic coding), then the sinusoidal signals which are non-harmonic signals are encoded (Individual Line Coding), and finally noise signals are encoded.

The harmonic signals are referred to as the sinusoidal signals having frequency ($\omega$, $2\omega$, $3\omega$, . . . ), that is, a multiple of frequency $\omega$ of a fundamental frequency signal or the sinusoidal signal having a predetermined correction value ($\omega$, $2\omega+\epsilon 0$, $3\omega+\epsilon 1$, . . . ) for a multiple of the fundamental frequency signal. The correction value can be expressed by a specific equation. Since frequency is known when the harmonic signals are encoded, only amplitude and phase need to be coded and thus efficient coding is possible. The efficient coding means that information can be represented by using smaller sized data.

On the other hand, when sinusoidal signals that are not harmonic signals are encoded, the frequency, amplitude, and phase should all be encoded.

When representing the amplitudes of the harmonic signals, a Linear Predictive Coding (LPC) method is used in a HILN coding method. Encoding the amplitudes of the harmonic signals is called encoding an envelope. In envelope coding, an LPC method is used. However, a more efficient method will be suggested in the present invention.

SUMMARY OF THE INVENTION

The present invention provides a method and apparatus for encoding an audio signal including an efficient envelope coding method and a computer readable recording medium having embodied thereon a computer program for executing the method of encoding an audio signal.

The present invention also provides a method and apparatus for decoding an audio signal to decode data encoded by using the method of encoding an audio signal and a computer readable recording medium having embodied thereon a computer program for executing the method of decoding an audio signal.

According to an aspect of the present invention, there is provided a method of encoding an audio signal including: performing harmonic analysis with respect to an input signal to determine harmonic parameters with respect to harmonic signals; regarding amplitudes of the harmonic signals included in the harmonic parameters as signals in a time domain so as to perform a time-frequency transformation; and encoding the time-frequency transformed values.

The regarding the amplitudes of the harmonic signals as the signals in the time domain so as to perform a time-frequency transformation may include: numbering the harmonic signals sequentially starting from a lowest frequency; and regarding the numbers as frame numbers of the signal in the time domain so as to perform a time-frequency transformation with respect to the amplitudes of the harmonic signals.

The encoding of the time-frequency transformed values may include: selecting a predetermined number of values from among the transformed values from a low frequency region; and encoding the selected values.

The time-frequency transformation may be one of Discrete Cosine Transformation (DCT), Modified Discrete Cosine Transformation (MDCT), and Fast Fourier Transformation (FFT).

The harmonic parameters may include frequency, amplitude, and phase of the harmonic signals.

The harmonic parameters may further include amplitude of a sinusoidal signal having a frequency with a predetermined correction value for a multiple frequency of a fundamental frequency signal.

According to another aspect of the present invention, there is provided an apparatus for encoding an audio signal including: a harmonic analyzing unit, which performs a harmonic analysis with respect to an input signal and determines harmonic parameters with respect to harmonic signals; a time-frequency transforming unit, which regards the amplitudes of the harmonic signals included in the harmonic parameters as signals in a time domain so as to perform a time-frequency transformation; and a transformed value encoding unit which encodes time-frequency transformed values.

The time-frequency transforming unit may number the harmonic signals sequentially starting from a lowest frequency and regards the numbers as frame numbers of the signal in the time domain so as to perform a time-frequency transformation.

The transformed value encoding unit may select a predetermined number of values from among the transformed values from a low frequency region and encode the selected values.

The time-frequency transformation may be one of DCT, MDCT, and FFT.

The harmonic parameters may include frequency, amplitude, and phase of the harmonic signals.

The harmonic parameters may further include amplitude of a sinusoidal signal having a frequency with a predetermined correction value for a multiple frequency of a fundamental frequency signal.

According to another aspect of the present invention, there is provided a method decoding an audio signal including: decoding encoded data to determine time-frequency transformed values; applying inverse transformation of the time-frequency transformation to the time-frequency transformed values so as to determine amplitudes of harmonic signals in a time domain; and regarding the harmonic signals in the time domain as signals in the frequency region so as to determine the amplitudes of the harmonic signals in the frequency region.

The regarding of the harmonic signals as the signals in the frequency region to determine the amplitudes of the harmonic signals may include: numbering the harmonic signals in the time domain sequentially; and determining a value, obtained by multiplying a fundamental frequency by a number of the numbered harmonic signals, as the frequency of the harmonic signal that corresponds to the amplitudes.

The time-frequency transformation may be one of DCT, MDCT, and FFT.

According to another aspect of the present invention, there is provided an apparatus for decoding an audio signal including: a decoding unit, which decodes encoded data and determines time-frequency transformed values; a time-frequency inverse-transforming unit, which applies inverse transformation of the time-frequency transformation to the time-frequency transformed values so as to determine amplitudes of harmonic signals in a time domain; and a frequency region signal regarding unit, which regards the harmonic signals in the time domain as signals in the frequency region and determines the amplitudes of the harmonic signals in the frequency region.

The frequency region signal regarding unit may number the harmonic signals in the time domain sequentially and determine a value, obtained by multiplying a fundamental frequency by a number of the numbered harmonic signals, as the frequency of the harmonic signal that corresponds to the amplitudes.

The time-frequency transformation may be one of DCT, MDCT, and FFT.

BRIEF DESCRIPTION OF THE DRAWINGS

The above and other aspects of the present invention will become more apparent by describing in detail exemplary embodiments thereof with reference to the attached drawings in which.

DETAILED DESCRIPTION OF EXEMPLARY EMBODIMENTS OF THE INVENTION

Hereinafter, the present invention will be described more fully with reference to the accompanying drawings, in which exemplary embodiments of the invention are shown.

Figure 1:
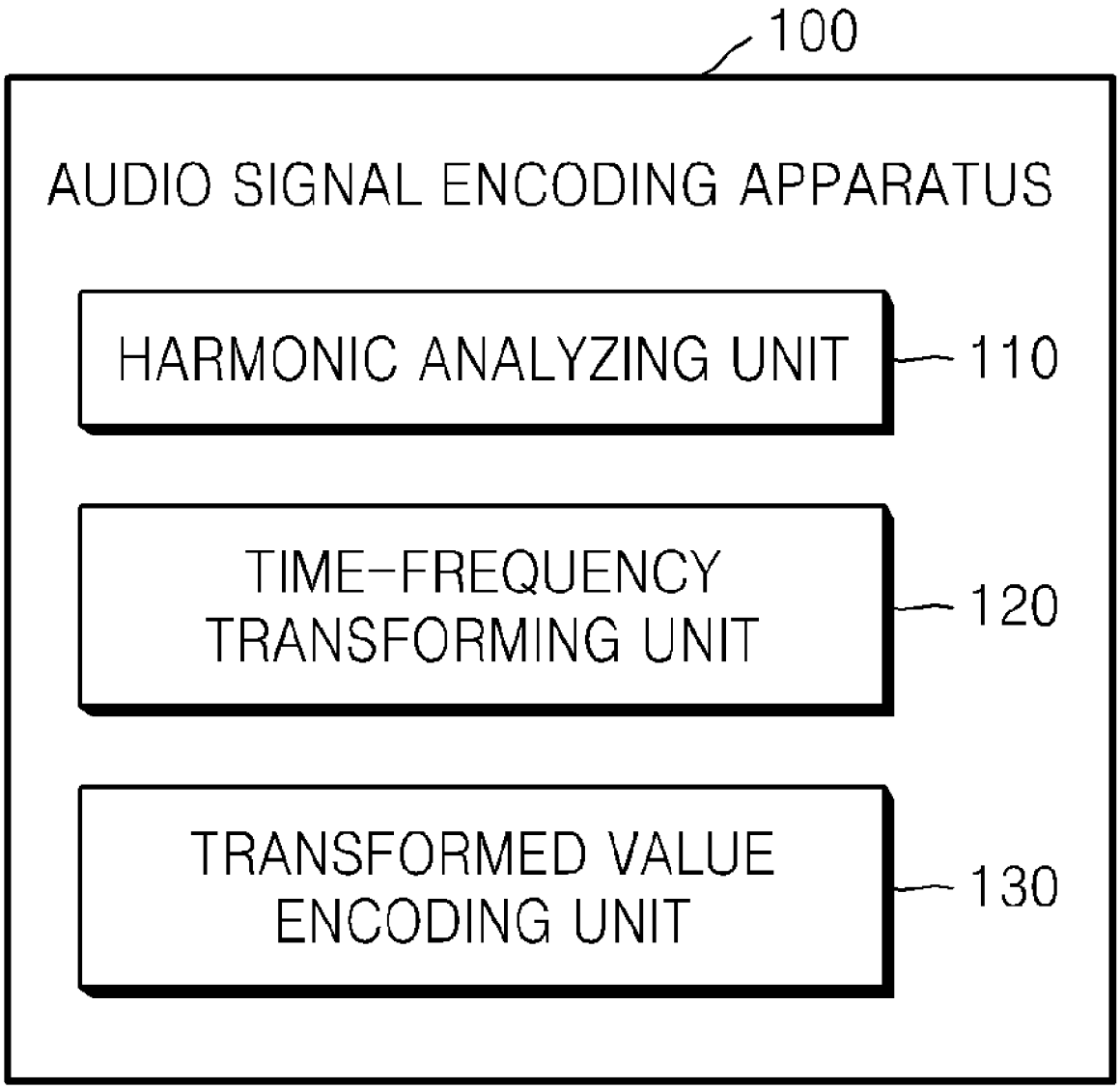
FIG. 1 is a block diagram of an apparatus for encoding an audio signal according to an exemplary embodiment of the present invention.
Figure 2:
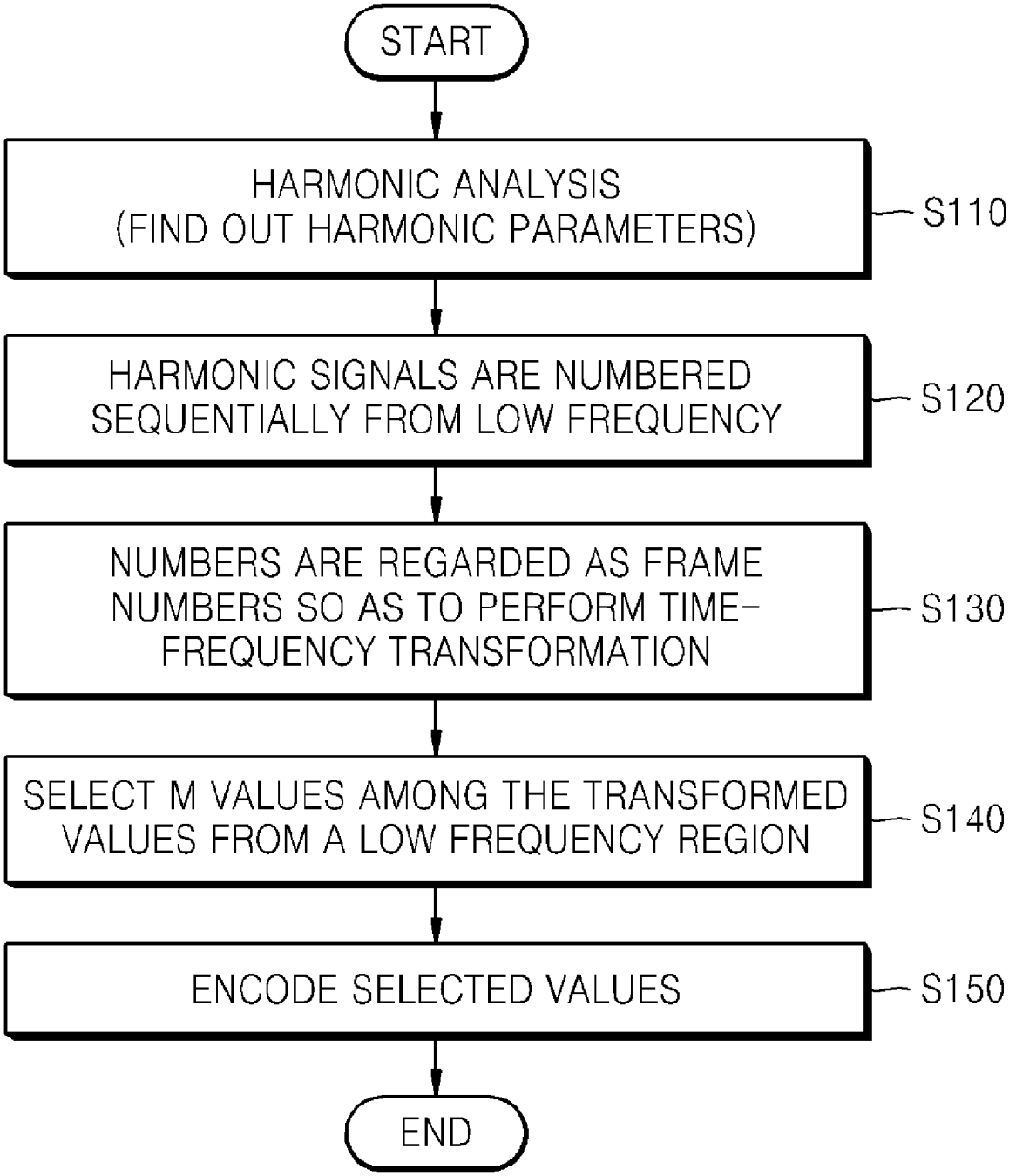
FIG. 2 is a flowchart of a method of encoding an audio signal according to an exemplary embodiment of the present invention.

FIG. 1 is a block diagram of an apparatus for encoding an audio signal according to an exemplary embodiment of the present invention. FIG. 2 is a flowchart of a method of encoding an audio signal according to an exemplary embodiment of the present invention.

Referring to FIGS. 1 and 2, an audio signal encoding apparatus 100 may include a harmonic analyzing unit 110, a time-frequency transforming unit 120, and a transformed value encoding unit 130.

The harmonic analyzing unit 110 performs a harmonic analysis with respect to an input signal and determines harmonic parameters with respect to harmonic signals in operation S110. The harmonic parameters are information on the harmonic signals including the frequency, amplitude, and phase thereof.

In general, the harmonic signal is referred to as a sinusoidal signal having a frequency that is a multiple of a fundamental frequency. However, a signal which is not exactly a multiple of a fundamental frequency can be substantially included as the harmonic signal. In other words, the harmonic parameters may further include not only the sinusoidal signal having a frequency that is a multiple of the fundamental frequency but also the amplitude of the sinusoidal signal having a predetermined correction value for a multiple frequency of a fundamental frequency signal.

The time-frequency transforming unit 120 regards the amplitudes included in the harmonic parameters as signals in the time domain so as to perform a time-frequency transformation.

In order to do so, the time-frequency transforming unit 120 firstly numbers the harmonic signals sequentially starting from the lowest frequency in operation S120. In operation S130, the numbers are regarded as frame numbers of the signal in the time domain so as to perform a time-frequency transformation.

Examples of the time-frequency transformation which are applied to the amplitudes include DCT, MDCT, or FFT.

The transformed value encoding unit 130 encodes time-frequency transformed values. Here, the transformed value encoding unit 130 selects m values from among the transformed values from a low frequency region in operation S140 and encodes the selected m values in operation S150.

Figure 3:
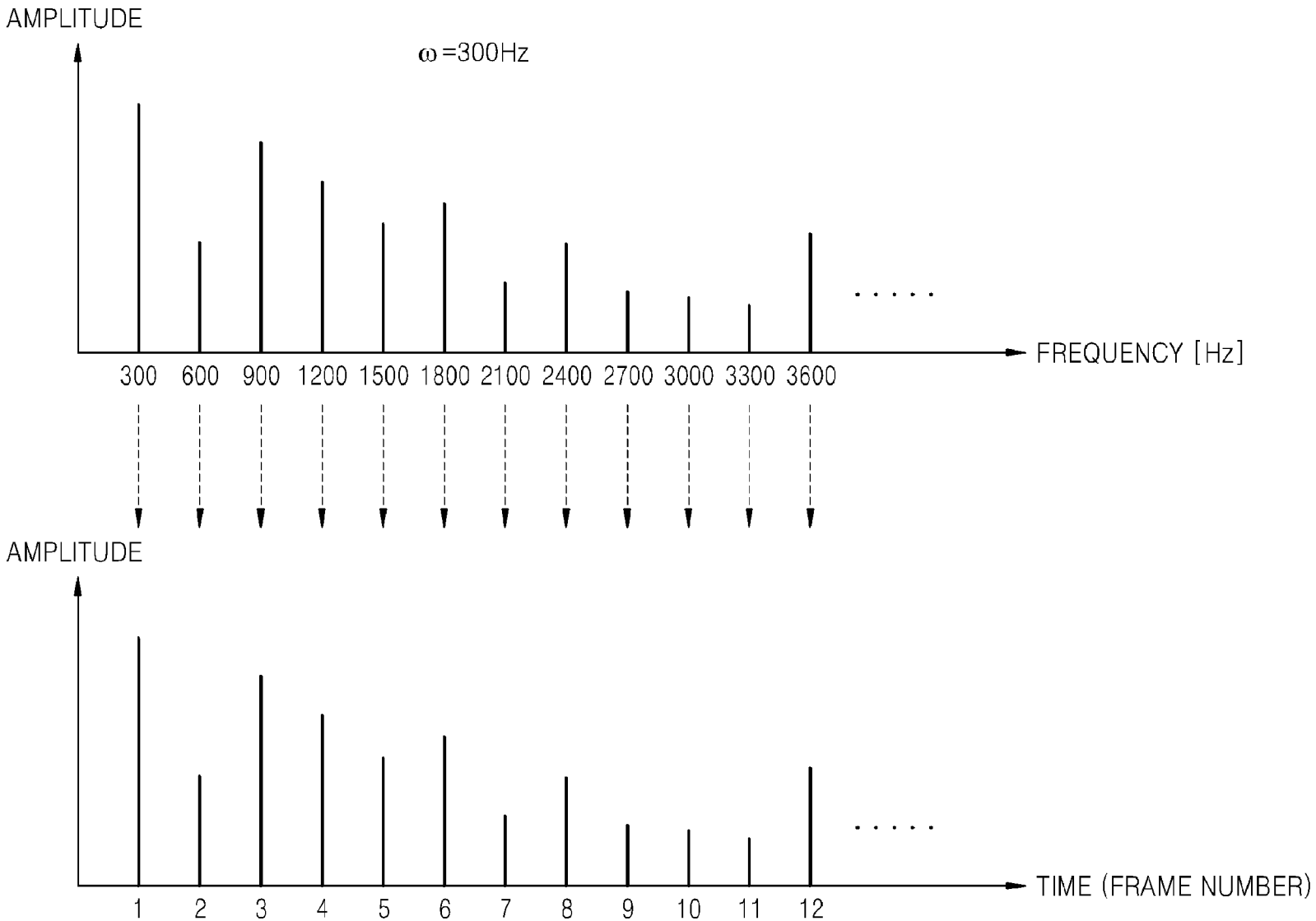
FIG. 3 is a diagram for explaining a method of regarding amplitudes of harmonic signals as signals in the time domain according to an exemplary embodiment of the present invention.

The operation which regards the amplitudes included in the harmonic parameters as signals in the time domain so as to perform a time-frequency transformation by the time-frequency transforming unit 120 will be described in more detail with reference to FIG. 3. FIG. 3 is a diagram for explaining a method of regarding the amplitudes of harmonic signals which have a fundamental frequency $\omega$ of 300 Hz, as the signals in the time domain according to an embodiment of the present invention.

Referring to FIG. 3, the harmonic signals are signals having frequencies of 300 Hz, 600 Hz, 900 Hz, 1200 Hz, 1500 Hz, and so on, which are multiples of the fundamental frequency. As mentioned above, the sinusoidal signals having frequencies that are not exactly a multiple of the fundamental frequency can be included in the harmonic signals. More specifically, variations between the frequency of the harmonic signal and the fundamental frequency increases when proceeding to the high frequency region.

The harmonic signals are numbered as 1, 2, 3, and so on sequentially starting from the frequency in a low frequency region. Here, if these numbers are regarded as the frame number in the time domain, the signals in the frequency region illustrated in the upper graph of FIG. 3 can be regarded as the signals in the time domain illustrated in the lower graph of FIG. 3.

Figure 4:
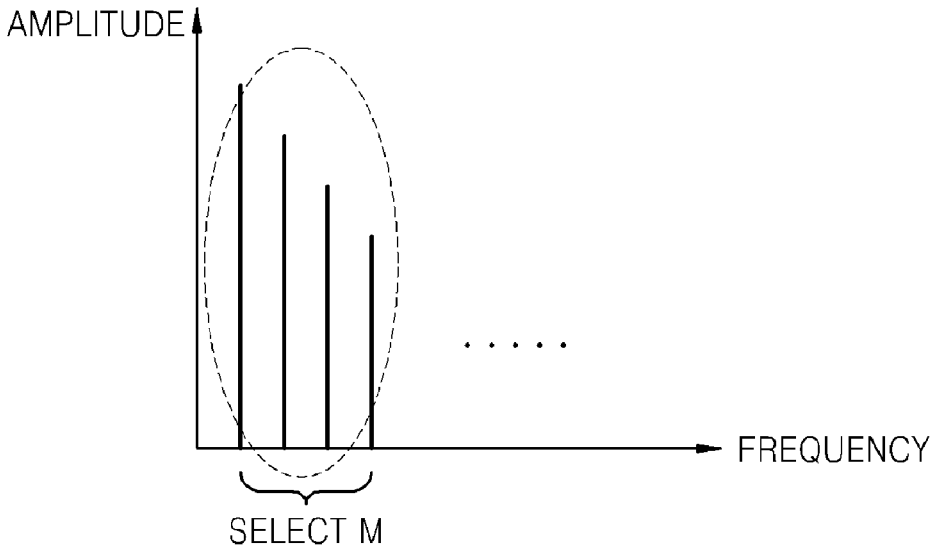
FIG. 4 is a graph illustrating a method of selecting m signals from among time-frequency transformed values according to an exemplary embodiment of the present invention.

FIG. 4 is a graph illustrating a method of selecting m signals from among the time-frequency transformed values according to an exemplary embodiment of the present invention.

The signals illustrated in FIG. 4 are results obtained by performing time-frequency transformation on the signals in the time domain illustrated in the lower graph of FIG. 3.

Referring to FIG. 4, the time-frequency transformed results are illustrated as the signals in the frequency region. Here, when the signals extend outside the low frequency region, the amplitudes of the signals significantly decrease. Therefore, the transformed value encoding unit 130 selects only the signals in the region before the signals significantly decrease for encoding. This is illustrated in FIG. 4 as m signals.

As such, if the signals having significantly decreased amplitudes outside of the m signals are removed, reproduced audio sound quality is not significantly affected. On the other hand, when only m signals are selected for encoding, a size of data after coding significantly decreases.

Therefore, sound quality is not adversely affected and coding efficiency greatly improves.

Hereinafter, a method and apparatus for decoding data encoded by the encoding method and apparatus will be described.

Figure 5:
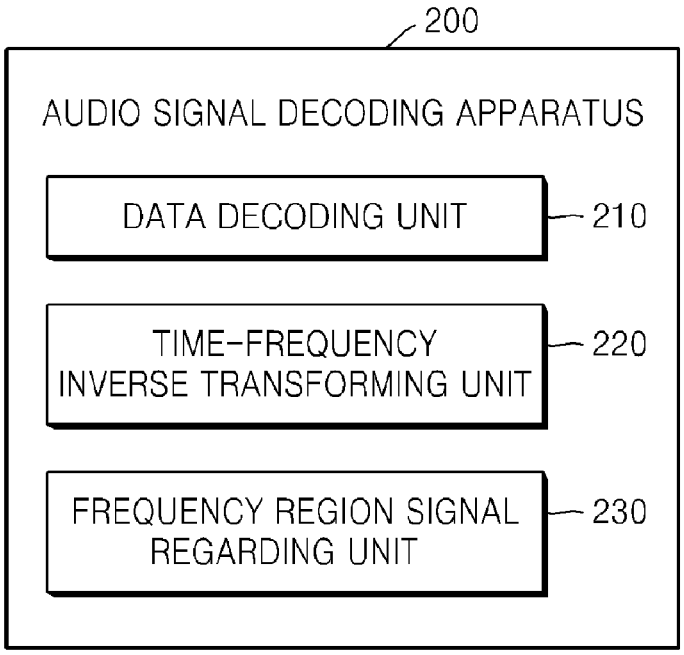
FIG. 5 is a block diagram of an apparatus for decoding an audio signal according to an exemplary embodiment of the present invention.
Figure 6:
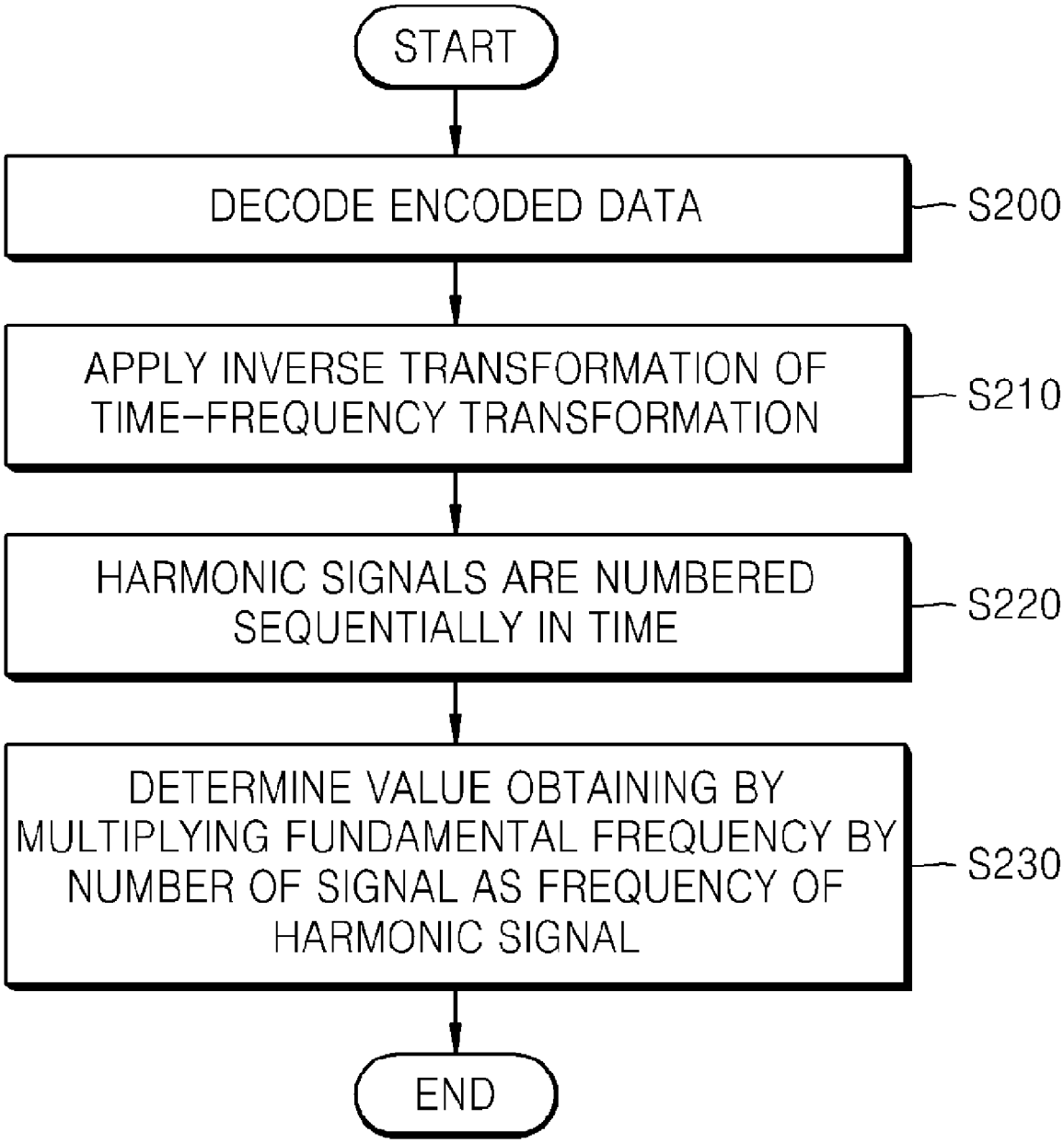
FIG. 6 is a flowchart illustrating a method of decoding an audio signal according to an exemplary embodiment of the present invention.

FIG. 5 is a block diagram of an apparatus for decoding an audio signal according to an exemplary embodiment of the present invention and FIG. 6 is a flowchart illustrating a method of decoding an audio signal according to an exemplary embodiment of the present invention.

Referring to FIG. 5, an audio signal decoding apparatus 200 may include a data decoding unit 210, a time-frequency inverse-transforming unit 220, and a frequency region signal regarding unit 230.

Referring to FIGS. 5 and 6, the data decoding unit 210 decodes the encoded data and determines time-frequency transformed values in operation S200.

The time-frequency inverse-transforming unit 220 applies inverse transformation of the time-frequency transformation to the time-frequency transformed values so as to determine amplitudes of harmonic signals in the time domain in operation S210. The harmonic signals in the time domain are the same signals illustrated in the lower graph of FIG. 3.

The frequency region signal regarding unit 230 regards the harmonic signals in the time domain as signals in the frequency region and determines the amplitudes of the harmonic signals in the frequency region. The harmonic signals in the frequency region are the same signals illustrated in the upper graph of FIG. 3.

In order for the harmonic signals in the time domain to be regarded as the harmonic signals in the frequency region, the operation to regard the harmonic signals in the frequency region as the signals in the time domain in the encoding apparatus described above is inversely performed.

That is, the harmonic signals in the time domain are respectively numbered sequentially in operation S220 and a value, obtained by multiplying the fundamental frequency by a number of the numbered harmonic signals, is determined as the frequency of the harmonic signal in operation S230.

In order to change the harmonic signals in the time domain illustrated in the lower part of FIG. 3 into the harmonic signals in the frequency domain illustrated in the upper part of FIG. 3, a value obtained by multiplying the fundamental frequency 300 Hz by each frame number is determined as the frequency of the harmonic signal.

According to the present invention, the amplitudes of the harmonic signals are regarded as signals in the time domain, when expressing a harmonic envelope, so as to perform a time-frequency transformation and only a part from among the transformed values is selected for encoding. Thus, sound quality is not affected and coding efficiency greatly improves.

The invention can also be embodied as computer (including all information processing devices) readable codes on a computer readable recording medium. The computer readable recording medium is any data storage device that can store programs or data which can be thereafter read by a computer system. Examples of the computer readable recording medium include read-only memory (ROM), random-access memory (RAM), CD-ROMs, magnetic tapes, floppy disks, optical data storage devices, and so on.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of encoding an audio signal, the method comprising:

performing harmonic analysis with respect to an input signal to determine harmonic parameters with respect to harmonic signals, wherein the harmonic parameters comprise amplitudes of the harmonic signals;

performing a time-frequency transformation by correlating the amplitudes of the harmonic signals included in the harmonic parameters to signals in a time domain instead of signals in a frequency domain, and applying a time-frequency transformation operation to the amplitudes in the time domain to generate time-frequency transformed values in the frequency domain; and encoding the time-frequency transformed values.

2. The method of claim 1, wherein the performing the time-frequency transformation comprises:

numbering the harmonic signals sequentially starting from a lowest frequency to a highest frequency; and performing the time-frequency transformation with respect to the amplitudes of the harmonic signals by referring to the numbering of the harmonic signals as frame numbers of the signal in the time domain.

3. The method of claim 1, wherein the encoding the time-frequency transformed values comprises:

selecting a predetermined number of values from among the time-frequency transformed values from a low frequency region; and encoding the selected predetermined number of values.

4. The method of claim 1, wherein the time-frequency transformation operation is one of Discrete Cosine Transformation (DCT), Modified Discrete Cosine Transformation (MDCT), and Fast Fourier Transformation (FFT).

5. The method of claim 1, wherein the harmonic parameters comprise frequency, amplitude, and phase of the harmonic signals.

6. The method of claim 1, wherein the harmonic parameters comprise an amplitude of a sinusoidal signal having a frequency with a predetermined correction value for a multiple frequency of a fundamental frequency signal.

7. An apparatus for encoding an audio signal, the apparatus comprising:

a harmonic analyzing unit, which performs a harmonic analysis with respect to an input signal and determines harmonic parameters with respect to harmonic signals, wherein the harmonic parameters comprises amplitudes of the harmonic signals;

a time-frequency transforming unit, which performs a time-frequency transformation by correlating the amplitudes of the harmonic signals included in the harmonic parameters to signals in a time domain instead of signals in a frequency domain, and applies a time-frequency transformation operation to the amplitudes in the time domain to generate time-frequency transformed values in the frequency domain; and a transformed value encoding unit which encodes the time-frequency transformed values.

8. The apparatus of claim 7, wherein the time-frequency transforming unit numbers the harmonic signals sequentially starting from a lowest frequency to a highest frequency, and performs a time-frequency transformation by referring to the numbers of the harmonic signals as frame numbers of the signal in the time domain.

9. The apparatus of claim 7, wherein the transformed value encoding unit selects a predetermined number of values from among the time-frequency transformed values from a low frequency region and encodes the selected predetermined number of values.

10. The apparatus of claim 7, wherein the time-frequency transformation operation is one of Discrete Cosine Transformation (DCT), Modified Discrete Cosine Transformation (MDCT), and Fast Fourier Transformation (FFT).

11. The apparatus of claim 7, wherein the harmonic parameters comprise frequency, amplitude, and phase of the harmonic signals.

12. The apparatus of claim 7, wherein the harmonic parameters comprise an amplitude of a sinusoidal signal having a frequency with a predetermined correction value for a multiple frequency of a fundamental frequency signal.

13. A computer readable recording medium having embodied thereon a computer program for executing a method comprising:

performing harmonic analysis with respect to an input signal to determine harmonic parameters with respect to harmonic signals, wherein the harmonic parameters comprises amplitudes of the harmonic signals;

performing a time-frequency transformation by correlating the amplitudes of the harmonic signals included in the harmonic parameters to signals in a time domain instead of signals in a frequency domain, and applying a time-frequency transformation operation to the amplitudes in the time domain to generate time-frequency transformed values in the frequency domain; and encoding the time-frequency transformed values.

14. A method of decoding an audio signal, the method comprising:

decoding encoded data to determine time-frequency transformed values in a frequency domain;

applying an inverse time-frequency transformation operation to the time-frequency transformed values so as to determine amplitudes of harmonic signals in a time domain; and determining the amplitudes of the harmonic signals in the frequency domain by correlating the harmonic signals in the time domain as harmonic signals in the frequency domain.

15. The method of claim 14, wherein the determining the amplitudes of the harmonic signals in the frequency domain comprises:

sequentially numbering the harmonic signals in the time domain; and determining a value, obtained by multiplying a fundamental frequency by a number of the numbered harmonic signals, as a frequency of the harmonic signal that corresponds to the amplitudes in the frequency domain.

16. The method of claim 14, wherein the inverse time-frequency transformation operation is one of Discrete Cosine Transformation (DCT), Modified Discrete Cosine Transformation (MDCT), and Fast Fourier Transformation (FFT).

17. An apparatus for decoding an audio signal, the apparatus comprising:

a decoding unit, which decodes encoded data and determines time-frequency transformed values in a frequency domain;

a time-frequency inverse-transforming unit, which applies an inverse time-frequency transformation operation to the time-frequency transformed values so as to determine amplitudes of harmonic signals in a time domain; and a frequency region signal regarding unit, which determines the amplitudes of the harmonic signals in the frequency domain by correlating the harmonic signals in the time domain as harmonic signals in the frequency domain.

18. The apparatus of claim 17, wherein the frequency region signal regarding unit sequentially numbers the harmonic signals in the time domain, and determines a value, obtained by multiplying a fundamental frequency by a number of the numbered harmonic signals, as a frequency of the harmonic signal that corresponds to the amplitudes in the frequency domain.

19. The apparatus of claim 17, wherein the inverse time-frequency transformation operation is one of Discrete Cosine Transformation (DCT), Modified Discrete Cosine Transformation (MDCT), and Fast Fourier Transformation (FFT).

20. A computer readable recording medium having embodied thereon a computer program for executing a method comprising:

decoding encoded data to determine time-frequency transformed values in a frequency domain;

applying an inverse time-frequency transformation operation to the time-frequency transformed values so as to determine amplitudes of harmonic signals in a time domain; and determining the amplitudes of the harmonic signals in the frequency domain by correlating the harmonic signals in the time domain as harmonic signals in the frequency domain.

* * * * *